United States Patent [19]

Esnault

[11] Patent Number: 4,924,932

[45] Date of Patent: May 15, 1990

[54] THERMOPLASTIC SHUTTER HAVING HORIZONTAL SECTIONS

[75] Inventor: Paul Esnault, Montardon, France

[73] Assignee: Peyrichou-Malan Societe Anonyme, Pau Cedex, France

[21] Appl. No.: 224,941

[22] Filed: Jul. 27, 1988

[30] Foreign Application Priority Data

Jul. 28, 1987 [FR] France ..... 87 11017
Jun. 15, 1988 [FR] France ..... 88 08400

[51] Int. Cl.[5] ..... E05D 15/20

[52] U.S. Cl. ..... 160/201; 160/232; 160/235

[58] Field of Search ..... 160/201, 229.1, 232, 160/235, 40, 206, 207, 233, 236

[56] References Cited

U.S. PATENT DOCUMENTS

| | | | |
|---|---|---|---|
| 2,083,467 | 6/1937 | Morris | 160/201 X |
| 2,494,001 | 0/0000 | Rowe | 160/229 |
| 2,880,796 | 0/0000 | Stroup | 160/232 |
| 3,056,451 | 10/1962 | Federline et al. | 160/201 |
| 3,527,283 | 9/1970 | Butler et al. | 160/229.1 |
| 3,980,123 | 9/1976 | Vago | 160/232 X |
| 4,205,713 | 6/1980 | Galbreath | 160/201 |
| 4,378,043 | 3/1983 | Sorenson | 160/201 X |
| 4,379,479 | 4/1983 | Whiting | 160/201 |

FOREIGN PATENT DOCUMENTS

| | | | |
|---|---|---|---|
| 1051271 | 1/1978 | Canada . | |
| 0031970 | 12/1980 | European Pat. Off. . | |
| 0159058 | 10/1986 | European Pat. Off. . | |
| 1486550 | 9/1977 | United Kingdom | 160/232 |

*Primary Examiner*—David M. Purol
*Attorney, Agent, or Firm*—Collard, Roe & Galgano

[57] ABSTRACT

A movable shutter to be placed over an opening is made up essentially of horizontal sections, each of which sections comprise an intermediate section or filler of polycarbonate. A male extrusion is fixed to the filler at the top and a female extrusion at the bottom. This makes it possible to assemble the sections together. The shutter is guided by rollers carried by the sections. These rollers move in vertical guiding tracks fixed on the opening and continue on horizontal tracks mounted from the ceiling. The operation of the shutter is made easier by means of a compensation spring fixed above the opening. An anti-dislocation lock is mounted forcibly inside or attached onto two partitions of the female extrusion. When the ball and socket of a hinge are interlocked, the guide and the shoulder of the anti-dislocation lock are superimposed and their respective holes are aligned. Thus, after the roller axle is inserted in the aligned holes, the extrusions can no longer become dislocated whatever the angle of rotation of the hinge.

6 Claims, 3 Drawing Sheets

FIG.1
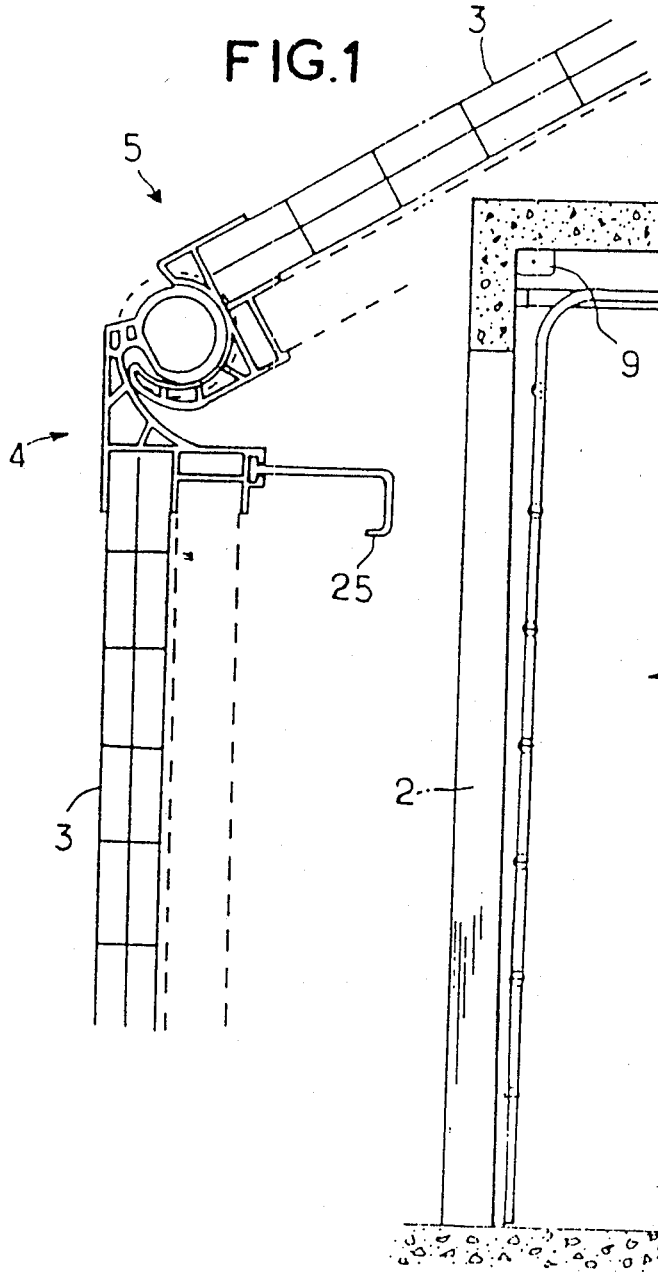
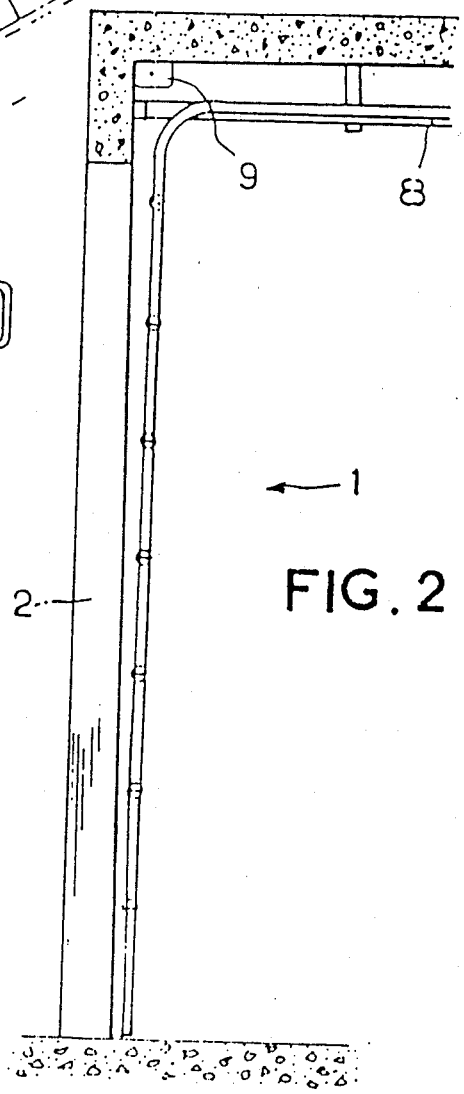
FIG. 2

THERMOPLASTIC SHUTTER HAVING HORIZONTAL SECTIONS

BACKGROUND OF THE INVENTION

1. Field of the Invention

This invention relates to a thermoplastic or a polycarbonate shutter having horizontal sections, which shutter is used for a gate or door to close any opening. The shutter has continuous hinges and has rollers moving in a track fixed on a sconcheon or framework of the opening.

2. Description of the Prior Art

At present, there exist doors or shutters made up of horizontal panels articulated at the sides. These shutters are made of galvanized steel plate or other metal, and the sides are reinforced by end pieces and cross pieces of steel plate which are fixed by means of rivets or any similar means. One drawback of this design lies in the fact that the assembly of the cross pieces and other steel elements on the shutter by means of rivets or other means results in their eventually loosening and causing a certain amount of play. This brings about variations which, among other things, increase the noise when the shutter is being operated. Moreover, the time necessary to install these elements is a penalizing factor in the cost of manufacture. In addition, in use these sectional shutters rise vertically then turn onto a horizontal plane by means of side tracks in which the rollers can move. To facilitate the operation of the shutters, they are provided with compensation springs connected between the frame and the shutter.

Another drawback lies in the hinges of these known shutters being positioned at both ends of the sections, thus making the non-hinged central horizontal sections weaker. The hinges are fixed by means of rivets or other means which magnify the loosening drawback described above. The known shutters are also fitted with intermediate hinges, which results in too much time being spent in assembly during manufacturing and affords no protection against the sections coming apart after assembly, which remains possible.

SUMMARY OF THE INVENTION

It is an object of the present invention to remedy these drawbacks and solve the aforementioned problem by providing a shutter design which makes it possible to manufacture a noiseless sectional shutter because of the elimination of play between non-articulated elements.

It is yet another object to provide a shutter having the added advantage of a very short manufacturing time, either in the shop or on site, which precludes all possibility of disengagement of the shutter sections because of a continuous hinge between sections of the shutter.

Accordingly, the present invention provides a shutter having on the one hand horizontal thermoplastic sections being made up of a filler element of polycarbonate resin, which resin is a retarded combustion resin. The horizontal sections interlock with each other along their whole length by means of male extrusions at the top of each section and female extrusions at the base of each section. The angle between the sections at the time of assembly is about 15°, and the two adjoining sections lock together in a manner allowing for an angle of rotation equal to or greater than 30°. The top and bottom extrusions of the sections are also made of polycarbonate. The male top extrusion carries a roller which moves inside vertical tracks fixed on the frame of the opening.

The extrusion, of course, can be made of thermoplastic and attached to the sections by bonding. This forms extremely strong interconnections which can never loosen as can the mechanical fasteners of the prior art.

The shutter also includes an anti-dislocation or disengagement lock to prevent the extrusions from being dislocated if the angle of rotation is less than 30°. This lock is forced into two partitions of the female bottom extrusion or is otherwise attached to them. The anti-dislocation lock is provided with a shoulder with a hole in it which, when assembled, is superimposed over the hole of a guide which supports the roller's axle. When superimposed, the holes are aligned in such a way that the roller's axle can be inserted into them. The guide is mounted forcibly into the inside cavity of the ball of the male extrusion at the top of each section.

The male and female extrusions forming the hinge between the sections can no longer come apart or be dislocated, whatever the angle of rotation of the hinge. Previously, there was a risk of dislocation when the angle of rotation was inferior to 30°, which corresponds to the angle of assembly of about 15°, and as long as the interlocking angle was not equal or superior to 30°. According to a second embodiment, the body of the anti-dislocation lock can be made up of one, two or several bars in such a way that these bars can be introduced into one, two or several partitions of the socket of the female extrusion of the hinge.

These and other objects and advantages of the present invention will become apparent form the following description of the accompanying drawings, which disclose several embodiments of the invention. It is to be understood that the drawings are to be used for the purpose of illustration only, and not as a definition of the invention.

BRIEF DESCRIPTION OF THE DRAWINGS

In the drawings, wherein similar reference characters denote similar elements throughout the several views:

FIG. 1 is a partial cross-sectional view of the two sections assembled by the extrusions;

FIG. 2 is a schematic cross-sectional view of the shutter after opening;

FIG. 6 is a schematic representation of a roller on its track;

FIG. 7 is a perspective view of a roller guide;

FIG. 8 is a perspective view of a roller;

DESCRIPTION OF THE PREFERRED EMBODIMENTS

Figure 3:
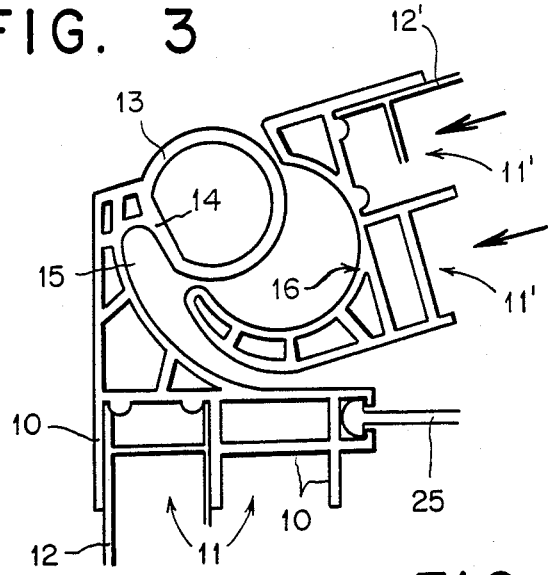
FIG. 3 is a cross-sectional view of the male and female extrusions.
Figure 4:
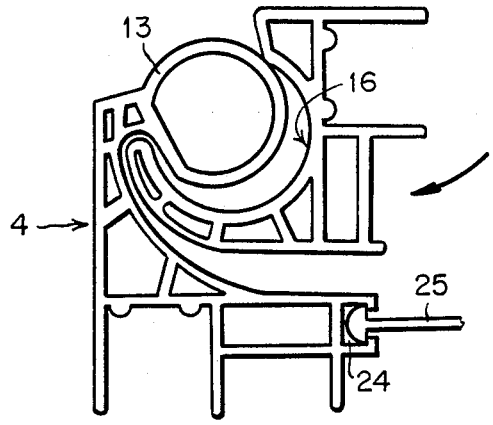
FIG. 4 is a cross-sectional view showing the angle of assembly of the male and female extrusions.
Figure 5:
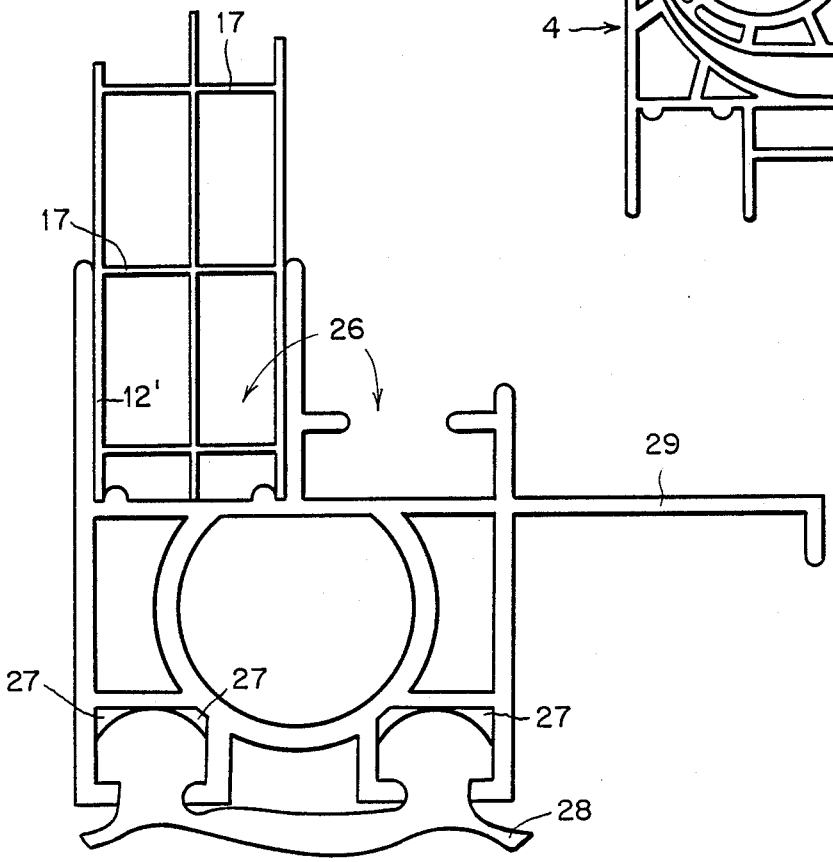
FIG. 5 is a cross-sectional view of the extrusion at the lower end of the shutter.
Figure 9:
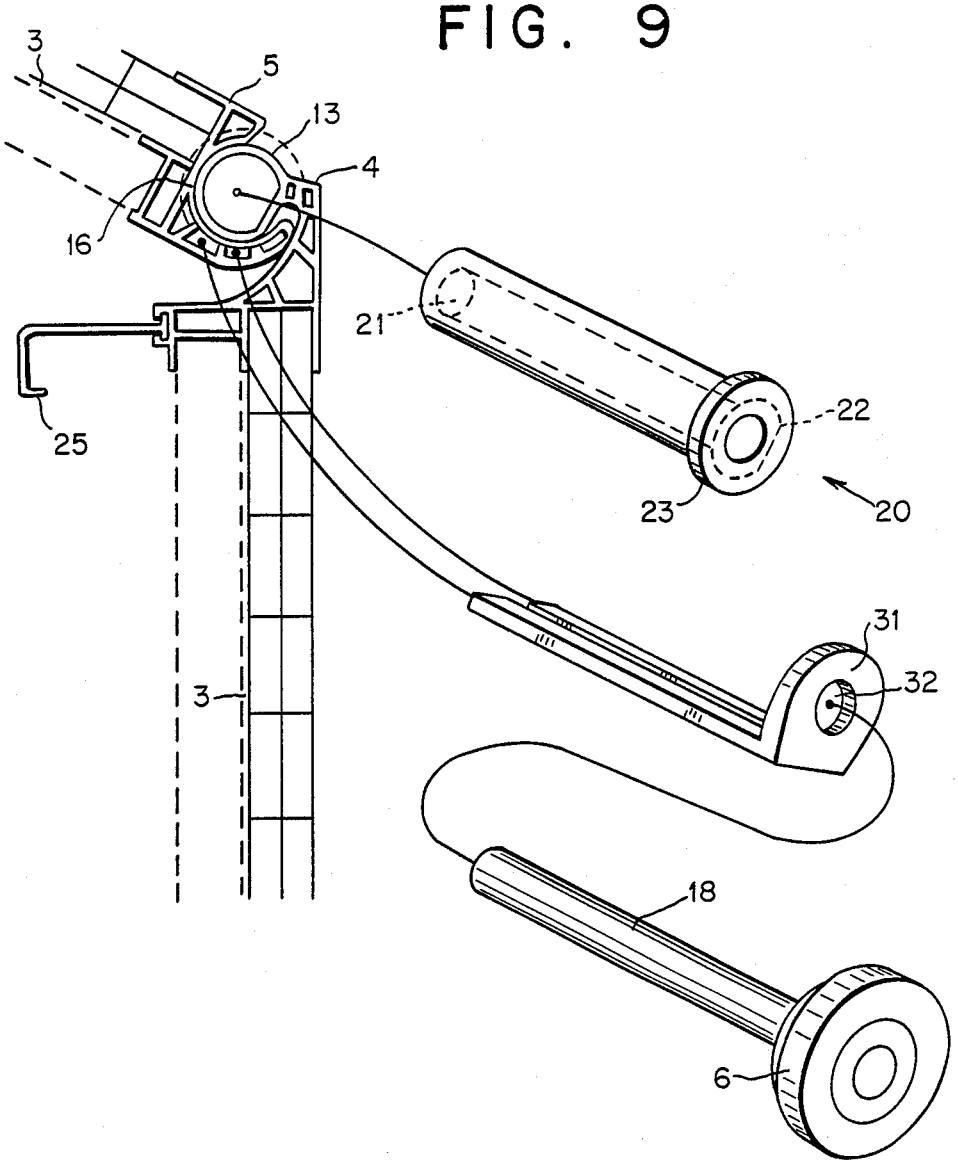
FIG. 9 is a perspective view of the anti-dislocation lock.
Figure 10:
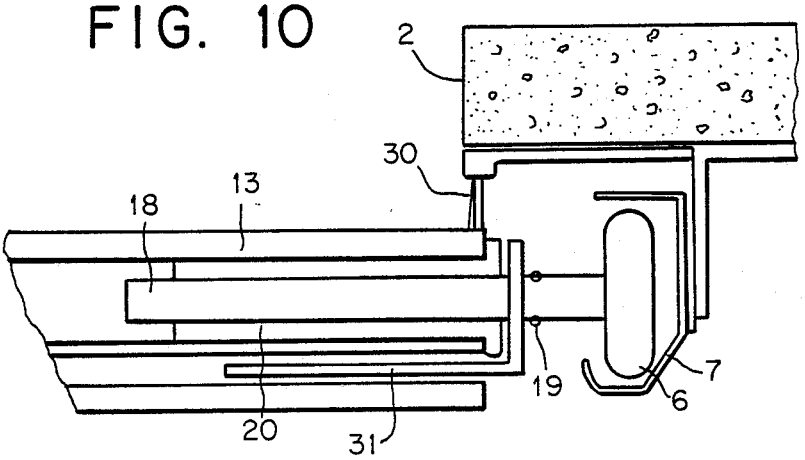
FIG. 10 is a schematic view of the mounting of the anti-dislocation lock into a partition of the female extrusion.

Referring to FIGS. 1–10, there is shown the device of the present invention having a shutter or door generally denoted as 1, placed on an opening 2. Shutter 1 is essentially made up of horizontal sections 3, each of which sections 3 comprises an intermediate portion or filler of polycarbonate; to each filler is fixed a male extrusion 4 at the top, and a female extrusion 5 at the bottom. Male extrusion 4 and female extrusion 5 make it possible to assemble sections 3 together. Shutter 1 is guided by rollers 6 camed by sections 3, which rollers 6 move in vertical guiding tracks 7 fixed on the opening 2 and which tracks 7 continue in the form of horizontal tracks 8 on or parallel to the ceiling. The operation of shutter or door 1 is made easier by means of a well known compensation spring 9 fixed above opening 2.

According to the present invention, top and bottom extrusions 4 and 5 of sections 3 make it possible to assemble a plurality of sections to form shutter 1. Extrusions 4 and 5 are provided along the whole horizontal extent of the shutter section 3, thus forming a continuous hinge.

Male extrusion 4 comprises a first part made up of a series of walls 10 perpendicular to each other and forming two parallel housings or openings 11, to receive the upper edges 12 of the polycarbonate filler elements of sections 3. The first part of the extrusion is extended on the opposite side of housings 11 by a roughly cylindrical male extension part forming the ball 13 of the hinge. The ball 13 is cut by a segment forming a flat surface which is located at the far end of a groove 15 formed in extrusion 4. Groove 15 forms a locking portion for capturing an extension 16' on female bottom extrusion 5.

Female bottom extrusion 5 includes a part forming two housings or openings 11' to receive the lower edges 12' of the polycarbonate filler elements of shutter 3. Female extrusion 5 extends at its opposite side from housings 11' with an extension having a concave cylindrical shape forming a female part in the form of the socket 16 of the hinge. Socket 16 includes extension 16' which goes around the bottom of ball 13 of male extrusion 4 and into groove 15.

To assemble the sections, female extrusion 5 is placed at an angle of about 15° with respect to male extrusion 4 of the next downward shutter section 3 (see FIG. 3). Female extrusion 5 is then turned towards a horizontal plane in order to engage socket 16 with the ball 13 of the male extrusion (see FIG. 4). The female extrusion is then turned towards a vertical plane in order to engage the lower section.

Sections 3 are made of polycarbonate filler elements which comprise two or three walls divided by intermediate partitions 17 forming cells which increase the soundproofing and thermal insulation coefficients of the shutter. Rollers 6 are each fixed on an axle 18 provided with a boss 19, which boss 19 limits the penetration of axle 18 into a guide 20. Guides 20 are made up of a generally cylindrical rod whose outer face 21 is circular while the inside face has a flat portion 22 extending along its whole length. Flat portion 22 corresponds to the flat part 14 of ball 13 of the male extrusion. Guides 20 are forced into the open ends of balls 13 in their cylindrical end parts adjacent to the vertical sides of the shutter sections 3. Each guide 20 includes a stop 23 at its outer end. Stop 23 thus closes on both sides of the shutter the ends of extrusions 4 and 5 forming the hinge extending all along the horizontal length of the shutter.

Male extrusions 4 have a receptacle 24 along their entire length, preferably on the inner side, and a stiffener 25 is fixed in receptable 24 for increasing the inertia of the polycarbonate sections 3. The base of stiffener 25 is forcibly inserted into housing 24 and retained therein.

At its lower end, shutter 1 has an extrusion generally denoted as 50 having two receptacles or openings 26 to capture the lower edges 12' of the bottom section 3 of shutter 1 and having on the other side thereof two openings 27 to capture extruded rubber bars or strips 28 which have lips to ensure proper sealing and insulation. Extrusion 50 also has a stiffener 29 all along the length of the shutter. Extruded rubber bars 30 having extending lips are also placed on the roller tracks all around the opening to ensure thermal insulation between the outer face of the shutter 1 and the frame of opening 2.

The device is also provided with an anti-dislocation lock 31 having a body forcibly mounted or attached onto two partitions of female extrusion 5. When the ball and socket of the hinge are interlocked, the guide 20 and the shoulder of the anti-dislocation lock 31 are superimposed and their respective holes 21 and 32 are aligned. Thus, when the axle 18 of the roller 6 is introduced into the hole 32 of the shoulder of the anti-dislocation lock 31 and into the hole 21 of the guide 20, female and male ports 16 and 13, and thus extrusions 4 and 5, can no longer come apart whatever the angle of rotation of the hinge formed by extrusions 4 and 5.

The device according to the invention can be used for polycarbonate shutters in horizontal sections for a gate or any such opening, comprising continuous hinges and rollers moving on tracks, for which shutters it is desired to ensure a non-dislocatable assembly of the hinges of the sections.

While several embodiments of the present invention have been shown and described, it will be obvious that many changes and modifications may be made thereunto without departing from the spirit and scope of the invention.

What is claimed is:

1. A thermoplastic shutter comprising:

a plurality of horizontal panels each having upper and lower horizontal sides and formed of a filler element of multiple thickness of polycarbonate resin;

a horizontal lower polycarbonate extrusion extending along the lower horizontal side of each panel;

a horizontal upper polycarbonate extrusion extending along the upper horizontal side of each panel;

a hinged connection connecting adjacent upper and lower extrusions of adjacent panels consisting of a ball joint having a male part connected to one of said upper and lower extrusions substantially at right angles to the plane of the panel and a female part connected to the other one of said upper and lower extrusions and having an engagement slot therein to engage said male part, said engagement slot facing away from the angular motion of the hinged connection;

a roller arranged in a guide on each lateral side of each upper extrusion adapted to run along vertical and horizontal tracks with a compensation spring facilitating the handling of the shutter; and stiffening means for each panel consisting of a jawlike horizontal recess having walls formed in the upper extrusion and strengthener having an enlarged horizontal element adapted for forcible insertion with said jawlike recess;

said adjacent upper and lower extrusions being aligned immediately prior to being hingedly coupled at an angle of 15° and then locked together at a rotation angle of 30°.

2. The thermoplastic shutter as defined in claim 1, wherein said each upper extrusion comprises two receptacle housings on one side thereof for the receipt therein of the upper horizontal side of a horizontal panel and on the opposing side a cylindrical projection forming the male part of the ball joint which defines a groove with said upper extrusion having a flat surface thereon arranged at the far end of the groove.

3. The thermoplastic shutter as defined in claim 2, wherein said lower extrusion comprises two receptacle housings on one side thereof for the receipt therein of the lower horizontal side of a horizontal panel and a curved shape on the opposing side thereof forming the female part of the cylindrical ball joint socket.

4. The thermoplastic shutter as defined in claim 1, wherein each of said rollers includes an axle disposed in a guide forcibly positioned in the ball joint of the upper extrusion which is blocked by a flat section on the inside of a central opening of the ball joint.

5. The thermoplastic shutter as defined in claim 4, wherein each of said guides has a stop one end and a flat part formed along the length of a cylindrical section thereof adapted to cooperate with the flat section on the inside of the central opening of the ball joint.

6. The thermoplastic shutter as defined in claim 2, wherein said ball joint is arranged centrally with respect to said upper and lower extrusions.

* * * * *